United States Patent [19]

Kamilos et al.

[11] Patent Number: 4,811,786

[45] Date of Patent: Mar. 14, 1989

[54] DOWNHOLE GASEOUS LIQUID FLOW AGITATOR

[75] Inventors: G. N. Kamilos, Dublin; D. D. Kennedy; L. J. Lederhos, Jr., both of Bakersfield, all of Calif.

[73] Assignee: Chevron Research Company, San Francisco, Calif.

[21] Appl. No.: 794,341

[22] Filed: Oct. 31, 1985

[51] Int. Cl.[4] ..... E21B 43/24; B01F 03/02

[52] U.S. Cl. ..... 166/303; 166/57; 166/305.1; 261/DIG. 76; 261/110; 366/339

[58] Field of Search ..... 166/305.1, 303, 279, 166/57, 242, 233, 231, 227, 272; 366/338, 339

[56] References Cited

U.S. PATENT DOCUMENTS

| | | | |
|---|---|---|---|
| 129,025 | 7/1872 | Harris | 166/227 |
| 2,512,471 | 6/1950 | Trist | 366/339 |
| 3,647,187 | 3/1972 | Dannewitz et al. | 366/339 |
| 4,111,402 | 9/1978 | Barbini | 366/338 |
| 4,522,504 | 6/1985 | Greverath | 366/338 |
| 4,537,513 | 8/1985 | Flesher et al. | 366/339 |
| 4,646,828 | 3/1987 | Schwab, Jr. | 166/117.5 |

FOREIGN PATENT DOCUMENTS

| | | | |
|---|---|---|---|
| 8103457 | 2/1983 | Fed. Rep. of Germany | 166/227 |
| 1209603 | 10/1970 | United Kingdom | 366/339 |
| 2099049 | 12/1982 | United Kingdom | 166/272 |

*Primary Examiner*—Jerome W. Massie
*Assistant Examiner*—Terry Lee Melius
*Attorney, Agent, or Firm*—S. R. La Paglia; E. J. Keeling; E. A. Schaal

[57] ABSTRACT

An apparatus and process of mixing a gaseous phase and a liquid phase within a tubing string in a well bore is described. The apparatus and process form a homogeneous gaseous phase liquid phase mixture without requiring a blocking restriction within the tubing string.

14 Claims, 1 Drawing Sheet

DOWNHOLE GASEOUS LIQUID FLOW AGITATOR

FIELD OF THE INVENTION

This invention relates to downhole agitators. More particularly, this invention relates to an apparatus for mixing a vapor phase and a liquid phase in a well bore and specifically for creating a uniform quality wet steam.

BACKGROUND OF THE INVENTION

Oil field operations often require the injection of a mixture of gaseous and liquid components to enhance the production of hydrocarbons from a hydrocarbon-bearing formation. Wet steam, i.e., steam that has a water phase and a vapor phase, is often injected in hydrocarbon fields having heavy hydrocarbons to assist the movement of the hydrocarbons within the formation toward a production well. Typically, a 10% to 80% quality steam is injected into the formation. As the liquid and vapor phases travel down the injection tubing toward the formation, the liquid phase tends to segregate out along the walls of the tubing while the vapor phase remains within the center of the tube. In order to adequately assess the quality of steam being injected into the formation, it is necessary to have a uniform steam quality or liquid and vapor mixture as it enters the formation.

Steam flow agitators are placed in the string of injection tubing to insure the mixing of the liquid and vapor phases. Many of these flow agitators are baffles or restrictions in the tubing which cause the vapor and liquid phases to intermix. However, these baffles can cause undesirable back pressure within the injection tubing and may eventually clog unless high-purity water is used. The clogging can occur more rapidly if additives such as surfactants, foaming agents, or other chemicals are utilized along with the injected steam. More importantly, well logging survey tools, such as temperature, pressure, and spinner tools, cannot be used because of the restriction in the injection tubing.

Thus, it would be highly desirable to have an agitator which intermixes the liquid and vapor phases prior to injection but does not present a blockage within the tubing and permits the use of logging tools to pass through the flow agitators.

SUMMARY OF THE INVENTION

We have invented a simple and effective flow agitator to intermix a partitioned liquid phase and vapor within a tubing string. The invention is based in part on our discovery that tube filling baffles or other types of blocking restrictions are not necessary to adequately mix the vapor and liquid phases. The apparatus mixes the liquid and vapor phases without requiring baffles or other blocking flow restrictors within the injection tubing which preclude the use of logging tools in the tubing string.

DETAILED DESCRIPTION OF THE INVENTION

Figure 1:
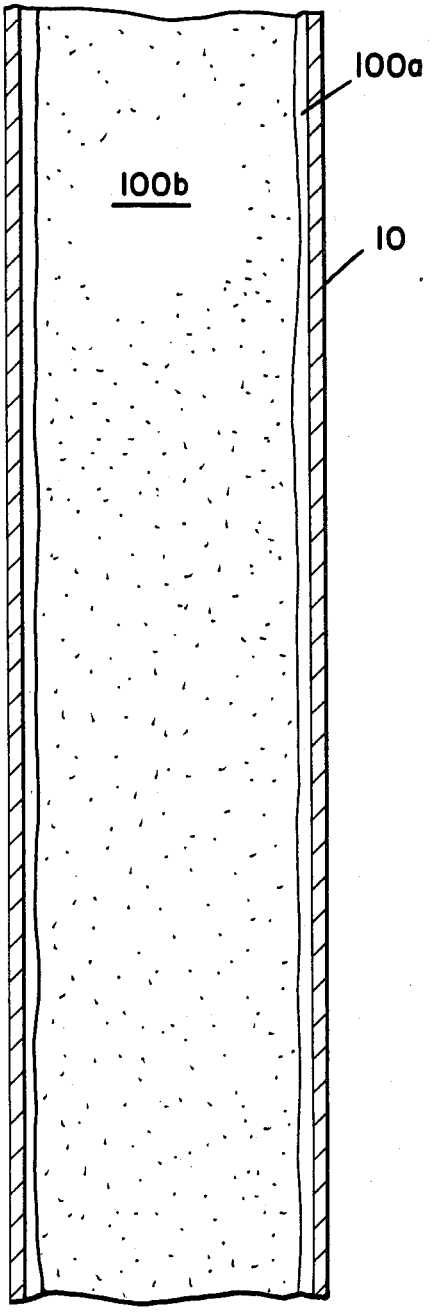
FIG. 1 illustrates a cross-sectional view of an injection tubing wherein a liquid phase has separated out from a vapor or gaseous phase.

The invention will be more clearly illustrated by referring to the Figures. FIG. 1 illustrates the problem encountered within an injection tubing hundreds or thousands of feet below the surface. The Figure illustrates annular flow conditions with a wet steam wherein the gas phase moves down the center of the tubing string and the liquid phase runs down the inner wall surface of the tubing string. More specifically, a vapor and liquid phase, such as a 50% steam quality, is injected into the tubing at the surface as a substantially uniform mixture of gaseous and liquid phases. Although a 50% quality steam is used as an example, it could be any quality steam varying from 1% to 99% quality and/or mixture of a non-condensible gas such as carbon dioxide, carbon monoxide, methane, and the like, with a liquid phase. Of course, the liquid and/or gas phase can contain additives such as surfactants and the like.

As the uniform mixture is injected into the tubing at the surface, it travels down the tubing to a producing formation where the mixture is injected to assist the movement of hydrocarbons toward a production well. The vapor and liquid phases have a tendency to separate out as the mixture passes down the injection tubing. FIG. 1 illustrates a section of an injection tubing 10 where the liquid phase **100*a* has either condensed out or separated out from the vapor phase 100*b* onto the injection tubing 10**. In order to optimize the production of hydrocarbons from a producing zone, it is necessary to know the steam quality that is actually injected into the formation. Unless it can be assumed that this is a complete homogeneous mixture, the injected mixture could have a quality which is either higher or lower than that injected at the surface.

Figure 2:
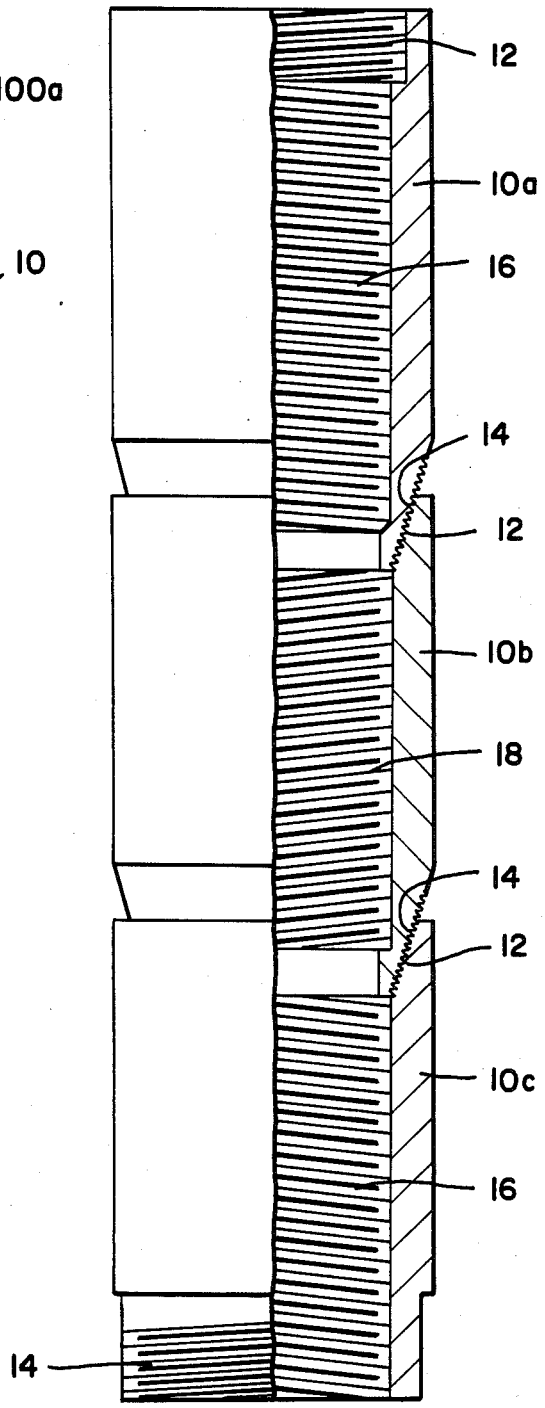
FIG. 2 illustrates a cut-away view of the flow agitator of our invention.

To ensure that the mixture is injected as a uniform mixture, the non-restrictive flow agitator of the invention is illustrated in FIG. 2. In FIG. 2, sections of the injection tubing **10*a*, 10*b* and 10*c*, are threadedly engaged through male and female joints 12 and 14, respectively. The tubing sections can be as long as standard tubing sections but preferably, the sections 12, 14 and 16** are from about 1 ft. to about 10 ft. and most preferably, 1.5 ft. to 3 ft. Alternatively, these sections of the injection tubing can be afffixed to each other by any other suitable means such as welding or gluing if extraction of these sections is not intended.

The interior of the tubing contains surface irregularities capable of causing the liquid phase to mix with the vapor or gas phase and form a homogeneous mixture without restricting the passage of logging tools therethrough. A surface irregularity which causes a flow reversal of the liquid phase moving down the tubing enhances the mixing. Alternating left-handed and right-handed threads are a preferred example of suitable surface irregularities which can agitate the liquid phase collecting against the interior surface of the injection tubing. Alternatively, the surface irregularities could be a coiled wire adhering to the interior surface of the tubing.

If an initial section of tubing has a left-hand thread or other surface irregularity, illustrated as 16, then the next injection tubing would have a threading or surface irregularity opposite thereto, i.e., right-handed threads 18, followed by left-handed threads 16 in injection tubing **10*c***. The length of the threads and the number of alternating threaded injection tubings is a function of the need to adequately mix the vapor and liquid phases prior to injection into the formation. This can vary from one or more injection tubes with interior surface irregularities or threads. Of course, the greater the number of injection tubing sections that contain threads of opposite handedness, the greater the mixing and the more uniform the injected material. The size of the threads is adjusted to adequately mix the material to be injected. Optionally, the thread sizes can be varied between individual tubing sections to further enhance the agitation of the liquid.

The surface irregularities are sized in conjunction with the thickness of the liquid layer. This layer can be derived from the steam quality. As an example, assuming annular flow conditions with a 2⅜" tubing with an I.D. of about 1.995", a temperature of 500° F., and a steam quality of 10%, 50%, or 80%, the thickness of the liquid layer would be 0.11", 0.015", or 0.004", respectively. Thus, the surface irregularities, i.e., threads, must be of sufficient size to cause the homogenizing of the gas and liquid phases. Generally, thread sizes of from about 4 to 20 threads or more per inch and preferably 8 to 12 threads per inch are sufficient. Other surface irregularities of similar dimensions would also be suitable. The depth of the threads from peak to groove is a function of the tubing thickness, this can vary but is preferably adjusted to form as small an angle as possible at the peak of each thread and in the groove between peaks while maintaining sufficient strength for the tubing to withstand the applied pressures. Of course, narrowing the diameter of the tubing would also increase the turbulence and thus enhance the mixing.

More generally, the water thickness can be derived by knowing the temperature, pressure, and volume of the steam to be injected, the steam quality, and the tubing diameter. Using common steam tables, the percentage of water at a given steam quality can be calculated. This is converted to a liquid area at a given tubing diameter from which the liquid thickness is derived using known standard area equations and solving for thickness, i.e., solving $$A_w = \pi\left(\frac{D_{TBg}}{2}\right)^2 - \left(\frac{D_{gas}}{2}\right)^2\pi$$

for thickness where $A_w$ is the area of liquid phase, $D_{TBg}$ is the tubing internal diameter and $D_{gas}$ is the central space diameter in the tube occupied by the gas phase under annular flow conditions. The surface irregularities are accordingly sized to cause uniform mixing of the gas and liquid phases prior to injection into the formation.

The invention has been described with reference to particularly preferred embodiments. Modifications which would be obvious to one of ordinary skill in the art are intended to be within the scope of the invention.

What is claimed is:

1. An apparatus for agitating and mixing a gaseous phase and a liquid phase comprising:

a first tube having non-blocking internal threads within said first tube to agitate a liquid phase adhering thereto with a gaseous phase passing therethrough, whereby a uniform gaseous phase and liquid phase mixture is formed; and a second tube connected to an end of said first tube having non-blocking internal threads of opposite handedness.

2. The apparatus according to claim 1 comprising a plurality of alternating first and second tubing sections connected together.

3. The apparatus according to claim 1 further comprising a third tube connected to said second tube wherein the threads of said first and third tubes are substantially the same and the threads of said second tube are opposite to said first and third tubes.

4. The apparatus according to claim 3 wherein the threads are right-handed threads for said first and third tubes and left-handed threads for said second tube.

5. The apparatus according to claim 3 wherein said first, second and third tubes are from about one to about 10 feet, said first, second and third tubes are inserted into a tubing string contained in a well bore above a perforation in said tubing string.

6. A process of intermixing a gaseous phase and a liquid phase injected at a wellhead within a well bore comprising:

injecting into an injection tubing string, within said well bore and above at least one perforation therein, at least two sections of tubing having non-blocking interior threads of opposite handedness sufficient to cause the agitation and dispersion of said liquid phase with said gaseous phase; and injecting said gaseous phase and said liquid phase into said injection tubing.

7. The process according to claim 6 wherein said gaseous phase and said liquid phase are injected as a homogeneous mixture.

8. The process according to claim 7 wherein said homogeneous mixture is wet steam.

9. The process according to claim 8 wherein the gaseous phase and liquid phase are injected separately.

10. The process according to claim 9 wherein the gaseous phase is selected from the group consisting of $CO_2$, CO, $CH_4$, $N_2$, 100% quality steam, and mixtures thereof and said liquid phase comprises $H_2O$.

11. In a tubing string suitable for carrying injected fluids which comprise a gaseous phase and a liquid phase into a well bore, said tubing has perforations therein adjacent to a formation into which said gaseous phase and liquid phases are to be injected, the improvement which comprises:

at least two sections of said tubing string above the perforations therein having non-blocking threads of opposite handedness contacting the interior surface of said tubing whereby said gaseous phase and liquid phase are mixed, said threads permitting the passage of logging tools therethrough.

12. The apparatus according to claim 1 wherein said sections are from about 1 to 10 feet in length.

13. The apparatus according to claim 12 wherein said tubing string contains three adjacent tubing sections and the first and third sections have threads of a given handedness and the second section between said first and third sections has threads of opposite handedness.

14. The apparatus according to claim 13 wherein a plurality of said sections are connected together above said perforations.

* * * * *

UNITED STATES PATENT AND TRADEMARK OFFICE

CERTIFICATE OF CORRECTION

PATENT NO. : 4,811,786

DATED : March 14, 1989

INVENTOR(S) : G. N. Kamilos et al

It is certified that error appears in the above-identified patent and that said Letters Patent is hereby corrected as shown below:

Claim 12, Col. 4, Line 56, "according to Claim 1" should read --according to Claim 11--

Signed and Sealed this

Twenty-eighth Day of November 1989

*Attest:*

JEFFREY M. SAMUELS

*Attesting Officer* *Acting Commissioner of Patents and Trademarks*